US008210821B2

(12) United States Patent
Arness et al.

(10) Patent No.: US 8,210,821 B2
(45) Date of Patent: Jul. 3, 2012

(54) LABYRINTH SEAL FOR TURBINE DOVETAIL

(75) Inventors: Brian P. Arness, Simpsonville, SC (US); Tara Easter McGovern, Simpsonville, SC (US); John D. Wardell, Simpsonville, SC (US); Omprakash Samudrala, Woodruff, SC (US)

(73) Assignee: General Electric Company, Schenectady, NY (US)

( * ) Notice: Subject to any disclaimer, the term of this patent is extended or adjusted under 35 U.S.C. 154(b) by 1029 days.

(21) Appl. No.: 12/168,932

(22) Filed: Jul. 8, 2008

(65) Prior Publication Data

US 2010/0007092 A1 Jan. 14, 2010

(51) Int. Cl.
*F03B 3/12* (2006.01)

(52) U.S. Cl. ..... 416/219 R

(58) Field of Classification Search ..... 416/219 R
See application file for complete search history.

(56) References Cited

U.S. PATENT DOCUMENTS

| | | | | |
|---|---|---|---|---|
| 3,709,631 | A | 1/1973 | Karstensen et al. | |
| 4,326,835 | A * | 4/1982 | Wertz | 416/193 A |
| 4,422,827 | A | 12/1983 | Buxe et al. | |
| 4,480,957 | A | 11/1984 | Patel et al. | |
| 4,494,909 | A | 1/1985 | Forestier | |
| 4,725,200 | A | 2/1988 | Welhoelter | |
| 4,743,164 | A | 5/1988 | Kalogeros | |
| 4,743,166 | A | 5/1988 | Elston, III et al. | |
| 5,052,890 | A | 10/1991 | Roberts | |
| 5,052,893 | A | 10/1991 | Catte | |
| 5,139,389 | A | 8/1992 | Eng et al. | |
| 5,257,909 | A | 11/1993 | Glynn et al. | |
| 5,599,170 | A | 2/1997 | Marchi et al. | |
| 5,823,743 | A | 10/1998 | Faulkner | |
| 6,273,683 | B1 | 8/2001 | Zagar et al. | |
| 6,296,172 | B1 | 10/2001 | Miller | |
| 6,375,429 | B1 * | 4/2002 | Halila et al. | 416/193 A |
| 6,565,322 | B1 | 5/2003 | Lieser et al. | |
| 6,575,704 | B1 | 6/2003 | Tiemann | |
| 6,682,307 | B1 | 1/2004 | Tiemann | |
| 2010/0068063 | A1 * | 3/2010 | Berg et al. | 416/223 A |

FOREIGN PATENT DOCUMENTS

| | | |
|---|---|---|
| EP | 0774048 A1 | 5/1997 |
| WO | 9412772 A1 | 6/1994 |

* cited by examiner

*Primary Examiner* — Richard Elms
*Assistant Examiner* — Harry W Byrne
(74) *Attorney, Agent, or Firm* — Sutherland Asbill & Brennan LLP

(57) ABSTRACT

A labyrinth seal that may include a first leg positioned about a high-pressure side of the dovetail tab, a second leg positioned about a low-pressure side of the dovetail tab, and a labyrinth chamber positioned between the first leg and the second leg. High-pressure fluid passing through the gap about the first leg expands within the labyrinth chamber so as to limit an amount of the high-pressure fluid that passes beyond the second leg.

15 Claims, 3 Drawing Sheets

LABYRINTH SEAL FOR TURBINE DOVETAIL

TECHNICAL FIELD

The present application relates generally to any type of turbine and more particularly relates to systems and methods for sealing the gap between a turbine bucket dovetail and a turbine rotor via a labyrinth seal.

BACKGROUND OF THE INVENTION

Gas turbines generally include a turbine rotor (wheel) with a number of circumferentially spaced buckets (blades). The buckets generally may include an airfoil, a platform, a shank, a dovetail, and other elements. The dovetail of each bucket is positioned within the turbine rotor and secured therein. The airfoils project into the hot gas path so as to convert the kinetic energy of the gas into rotational mechanical energy. A number of cooling medium passages may extend radially through the bucket to direct an inward and/or an outward flow of the cooling medium therethrough.

Leaks may develop in the coolant supply circuit based upon a gap between the tabs of the dovetails and the surface of the rotor due to increases in thermal and/or centrifugal loads. Air losses from the bucket supply circuit into the wheel space may be significant with respect to blade cooling medium flow requirements. Moreover, the air may be extracted from later compressor stages such that the penalty on energy output and overall efficiency may be significant during engine operation.

Efforts have been made to limit this leak. For example, one method involves depositing aluminum on a dovetail tab so as to fill the gap at least partially. Specifically, a 360-degree ring may be pressed against the forward side of the dovetail face. Although this design seals well and is durable, the design cannot be easily disassembled and replaced in the field. Rather, these rings may only be disassembled when the entire rotor is disassembled.

There is thus a desire for improved dovetail tab sealing systems and methods. Such systems and methods should adequately prevent leakage therethrough so as to increase overall system efficiency while being installable and/or repairable in the field.

SUMMARY OF THE INVENTION

The present application thus provides a labyrinth seal for a gap between a dovetail tab and a rotor. The labyrinth seal may include a first leg positioned about a high-pressure side of the dovetail tab, a second leg positioned about a low-pressure side of the dovetail tab, and a labyrinth chamber positioned between the first leg and the second leg. High-pressure fluid passing through the gap about the first leg expands within the labyrinth chamber so as to limit an amount of the high-pressure fluid that passes beyond the second leg.

The present application further provides a method of sealing a gap between a dovetail tab of a bucket and a rotor of a turbine. The method may include the steps of machining the dovetail tab to create a labyrinth chamber, operating the turbine, forcing high-pressure fluid into the gap, and expanding the high-pressure fluid within the labyrinth chamber so as to limit an amount of the high-pressure fluid passes beyond the labyrinth chamber.

The present application further provides a labyrinth seal for a gap between a dovetail tab and a rotor. The labyrinth seal may include a first leg positioned about a high pressure side of the dovetail tab, a second leg positioned about a low pressure side of the dovetail tab, and a labyrinth chamber positioned about a perimeter of the dovetail tab between the first leg and the second leg. High-pressure air passing through the gap about the first leg of the dovetail tab expands within the labyrinth chamber so as to limit an amount of the high-pressure air that passes beyond the second leg so as to limit an effective clearance of the gap about the second leg.

These and other features of the present application will become apparent to one of ordinary skill in the art upon review of the following detailed description when taken in conjunction with the several drawings and the appended claims.

DETAILED DESCRIPTION

Figure 1A:
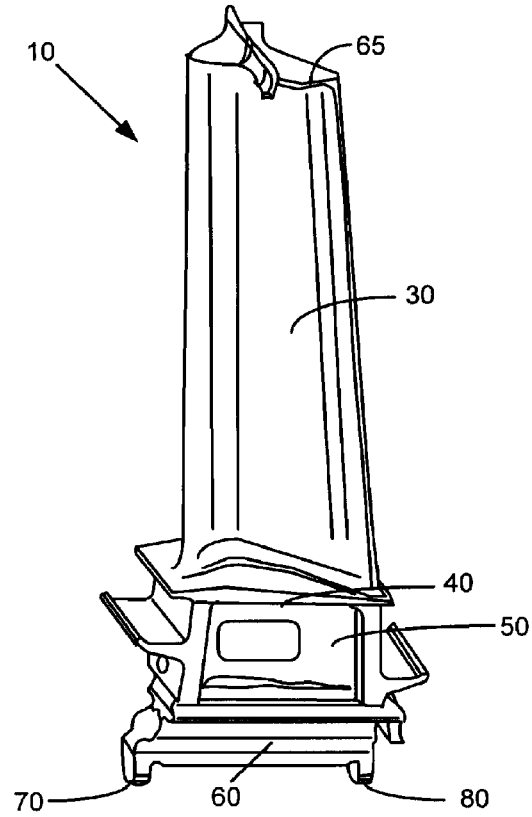
FIG. 1A is a perspective view of a bucket with a shroud that may be used with the sealing systems as are described herein.
Figure 2:
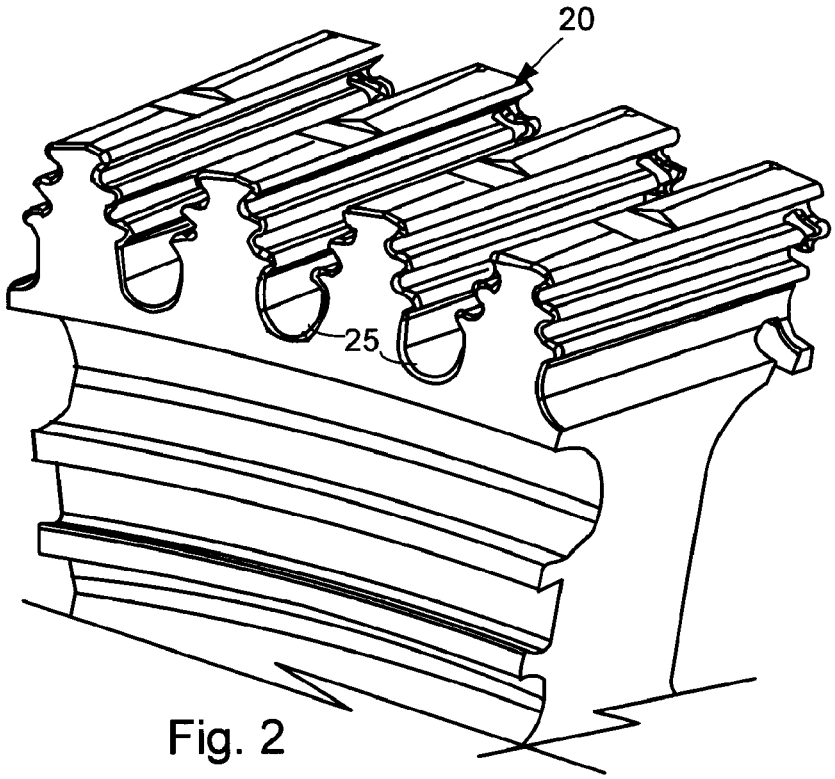
FIG. 2 is a perspective view of a rotor.

Referring now to the drawings, in which like numerals refer to like elements throughout the several views, FIG. 1A shows a bucket 10 as may be used herein. The bucket 10 may be a first or a second stage bucket as used in a 7FA+e gas turbine sold by General Electric Company of Schenectady, N.Y. Any other type of bucket or stage also may be used herein. The bucket 10 may be used with a rotor 20 as is shown in FIG. 2.

Figure 1B:
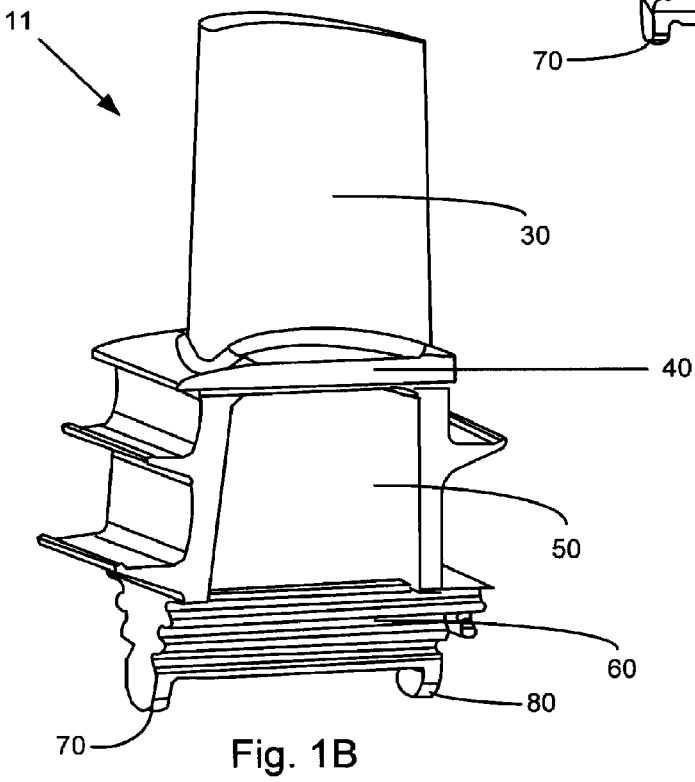
FIG. 1B is a perspective view of a bucket without a shroud that may be used with the sealing systems as are described herein.

As is known, the bucket 10 may include an airfoil 30, a platform 40, a shank 50, a dovetail 60, and other elements. It will be appreciated that the bucket 10 is one of a number of circumferentially spaced buckets 10 secured to and about the rotor 20 of the turbine. The bucket 10 of FIG. 1A has a shroud 65 on one end of the airfoil 30. The bucket 11 of FIG. 1B lacks the shroud. Any other type of bucket design may be used herein.

As described above, the rotor 20 may have a number of slots 25 for receiving the dovetails 60 of the buckets 10. Likewise, the airfoils 30 of the buckets 10 project into the hot gas stream so as to enable the kinetic energy of the stream to be converted into mechanical energy through the rotation of the rotor 20. The dovetail 60 may include a first tang or tab 70 and a second tab 80 extending therefrom. Similar designs may be used herein. A gap 90 may be formed between the ends of the tabs 70, 80 of the dovetail 60 and the rotor 20. A high pressure cooling flow may escape via the gap 90 unless a sealing system of some type is employed.

Figure 3:
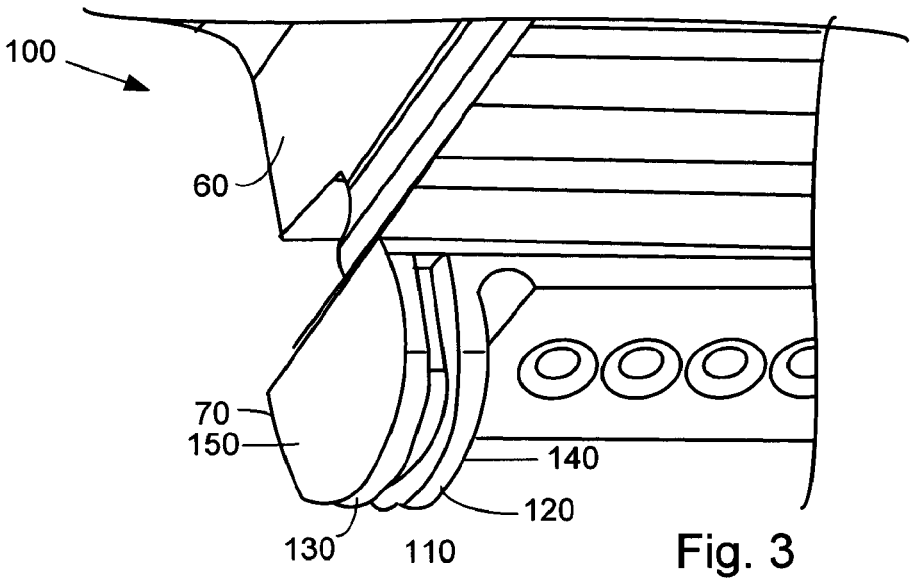
FIG. 3 is a perspective view of a labyrinth chamber of a labyrinth seal as is described herein.
Figure 4:
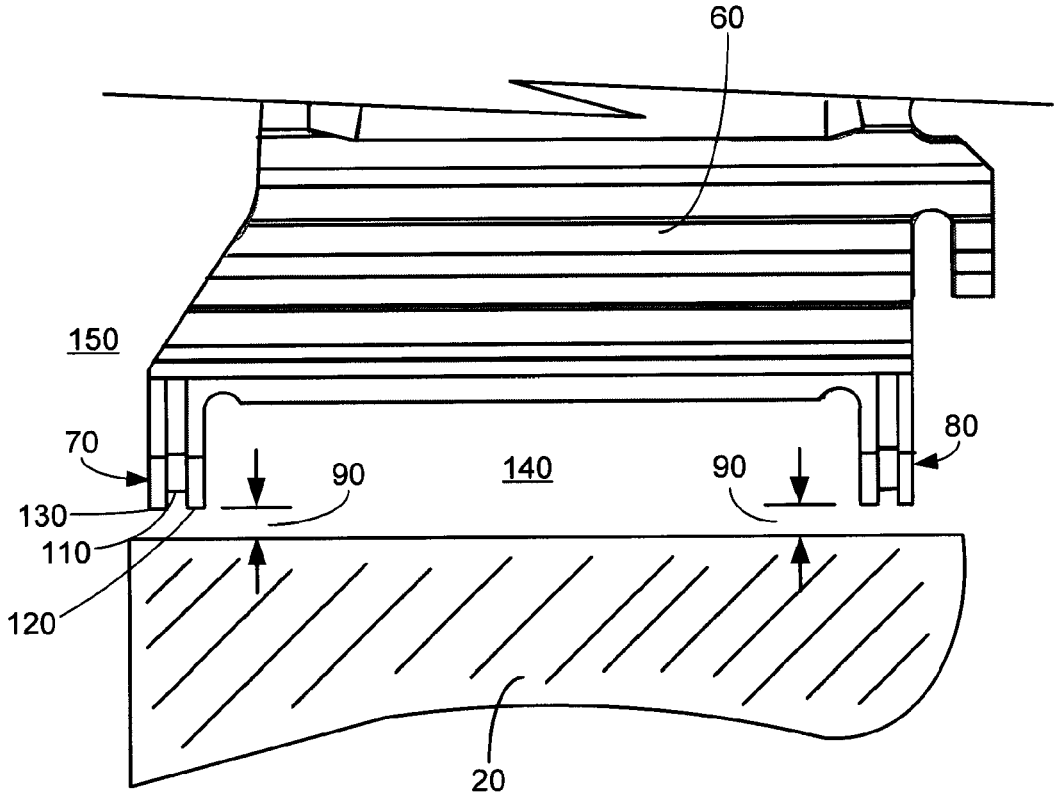
FIG. 4 is a side plan view of the labyrinth chamber of the labyrinth seal of FIG. 3.
Figure 5:
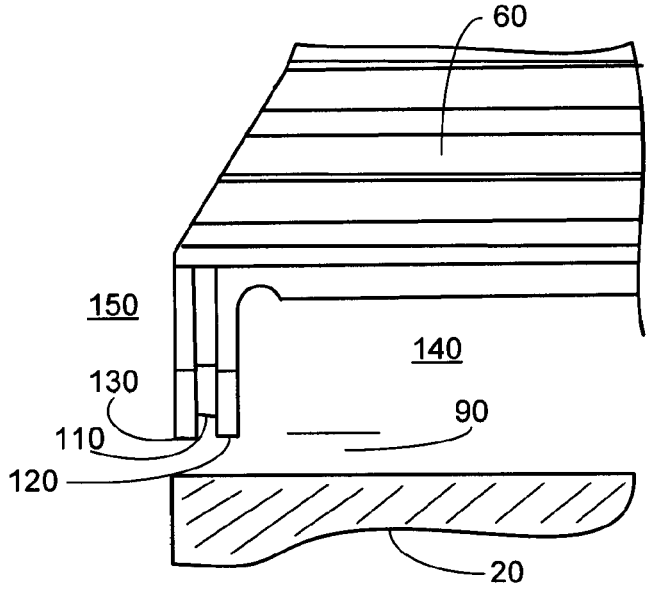
FIG. 5 is a side view of the labyrinth seal of FIG. 3 in operation with the rotor and the gap shown.

FIGS. 3-5 show a labyrinth seal 100 as is described herein. The labyrinth seal 100 may be positioned within and about the first tab 70 (the inner most tab) of the dovetail 60 of the bucket 10. The second tab 80 may have a similar labyrinth seal 100 as well. The labyrinth seal 100 may include a labyrinth chamber 110. The labyrinth chamber 110 may extend about the perimeter of the first tab 70. The dimensions and shape of the labyrinth chamber 110 may vary. The labyrinth chamber 110 may be formed integrally to the turbine blade dovetail 60 by any additive or subtractive means including but not limited to mechanically affixed via bolting or similar methods, welded assembly, conventional and non-conventional subtractive machining processes, weld or laser sintered building of labyrinth surfaces, or any combination thereof. Other types of manufacturing techniques also may be used herein. The labyrinth chamber 110 may have a square or a curved cross-sectional shape. Any desired cross-sectional shape may be used herein.

The labyrinth chamber 110 may define a first leg 120 and any number of subsequent second legs 130. The legs 120, 130 extend towards the gap 90 between the bucket 10 and the rotor 20. The first leg 120 may be positioned adjacent to a high-pressure side 140 of the dovetail 60. The high-pressure side 140 may provide the bucket cooling supply air. The second leg 130 may be positioned about a low-pressure side 150, i.e., the wheel space. The legs 120, 130 may have sharp corners or edges, but slightly rounded edges may be used.

In use, the high-pressure air or other fluids from the high-pressure side 140 about the first leg 120 of the dovetail 60 extends into the gap 90. The high velocity flow expands within the labyrinth chamber 110 so as to create vortices that impede the flow therethrough. Coolant loss through the gap 90 about the second leg 130 thus may be significantly reduced. The labyrinth chamber 110 and the legs 120, 130 thus form a labyrinth so as to reduce the airflow therethrough. Other configurations also may be used herein so as to deflect and/or reduce the airflow.

The labyrinth seal 100 also may be used about the second tab 80 or otherwise as may be desired. Moreover, adding the labyrinth seal 100 drops the effective clearance of the gap 90 from, for example, about ten (10) millimeters or more to about 8.6 millimeters. These clearance levels approach those of the known aluminum strips but without the addition of this further material. The reduction of the effective clearance and hence the reduction in cooling flow loss thus improves overall system efficiency. The labyrinth seal 100 also may be used with other sealing systems and methods.

The present application thus provides a non-contact, labyrinth seal 100 that is integrally formed about the turbine dovetail 60 for the gap 90 between the dovetail 60 and the rotor 20. The labyrinth seal 100 created by the legs 120, 130 and the gap 90 provides a non-contact flow sealing or control system by forcing the leakage flows from the high pressure side 140 into the labyrinth chamber 110 where the leakage flows produce a vortex or vortex-like fluid motion that reduces fluid leakages as compared to a similar gap that does not include the legs and the labyrinth chamber.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A labyrinth seal for a gap between a dovetail tab and a rotor, comprising:

a first leg extending inward in a radial plane along a profile of the dovetail tab and positioned about a high-pressure side of the dovetail tab;

a second leg extending inward in a radial plane along a profile of the dovetail tab and positioned about a low-pressure side of the dovetail tab, the first leg and the second leg being longitudinally spaced apart; and a labyrinth chamber extending outward in a radial plane and positioned between the first leg and the second leg such that high-pressure fluid passing through the gap about the first leg of the dovetail tab expands within the labyrinth chamber so as to limit an amount of the high-pressure fluid that passes beyond the second leg.

2. The labyrinth seal of claim 1, wherein the labyrinth chamber extends about a perimeter of the dovetail tab in whole or in part.

3. The labyrinth seal of claim 1, wherein the labyrinth chamber comprises a substantially square cross-sectional shape.

4. The labyrinth seal of claim 1, wherein the labyrinth chamber comprises a substantially curved cross-sectional shape.

5. The labyrinth seal of claim 1, wherein the labyrinth chamber comprises a substantially triangular cross-sectional shape.

6. The labyrinth seal of claim 1, further comprising a plurality of dovetail tabs.

7. A method of sealing a gap between a dovetail tab of a bucket and a rotor of a turbine, comprising:

machining the dovetail tab to create a labyrinth chamber between two longitudinally spaced legs that extend inward in a radial plane along a profile of the dovetail tab;

operating the turbine;

forcing high pressure fluid into the gap; and expanding the high-pressure fluid within the labyrinth chamber so as to limit an amount of the high-pressure fluid passes beyond the labyrinth chamber.

8. The method of claim 7, wherein the step of machining the dovetail tab comprises machining a labyrinth chamber with a substantially square cross-section.

9. The method of claim 7, wherein the step of machining the dovetail tab comprises machining a labyrinth chamber with a substantially curved cross-section.

10. The method of claim 7, wherein the step of machining the dovetail tab comprises machining a labyrinth chamber with a substantially triangular cross-section.

11. A labyrinth seal for a gap between a dovetail tab and a rotor, comprising:

a first leg extending inward in a radial plane along a profile of the dovetail tab and positioned about a high-pressure side of the dovetail tab;

a second leg extending inward in a radial plane along a profile of the dovetail tab and positioned about a low pressure side of the dovetail tab, the first leg and the second leg being longitudinally spaced apart; and a labyrinth chamber extending outward in a radial plane and positioned about a perimeter of the dovetail tab between the first leg and the second leg such that high-pressure fluid passing through the gap about the first leg of the dovetail tab expands within the labyrinth chamber so as to limit an effective clearance of the gap about the second leg.

12. The labyrinth seal of claim 11, wherein the labyrinth chamber comprises a substantially square cross-sectional shape.

13. The labyrinth seal of claim 11, wherein the labyrinth chamber comprises a substantially curved cross-sectional shape.

14. The labyrinth seal of claim 11, wherein the labyrinth chamber comprises a substantially triangular cross-sectional shape.

15. The labyrinth seal of claim 11, further comprising a plurality of dovetail tabs.

* * * * *

UNITED STATES PATENT AND TRADEMARK OFFICE

CERTIFICATE OF CORRECTION

PATENT NO. : 8,210,821 B2
APPLICATION NO. : 12/168932
DATED : July 3, 2012
INVENTOR(S) : Brian P. Arness et al.

It is certified that error appears in the above-identified patent and that said Letters Patent is hereby corrected as shown below:

Page 1, Inventors: – Delete "John D. Wardell" and insert --John D. Ward--

Signed and Sealed this
Twenty-eighth Day of August, 2012

David J. Kappos

David J. Kappos
*Director of the United States Patent and Trademark Office*